US005502294A

United States Patent [19]

Yang

[11] Patent Number: 5,502,294

[45] Date of Patent: Mar. 26, 1996

[54] CASH BOX WITH BILL WEIGHTS

[75] Inventor: John S. Yang, Northbrook, Ill.

[73] Assignee: Block and Company, Inc., Wheeling, Ill.

[21] Appl. No.: 516,520

[22] Filed: Aug. 17, 1995

Related U.S. Application Data

[63] Continuation of Ser. No. 364,417, Dec. 27, 1994, abandoned, which is a continuation of Ser. No. 111,991, Aug. 25, 1993, abandoned.

[51] Int. Cl.[6] ..... G07G 1/00

[52] U.S. Cl. ..... 235/7 R; 220/507; 109/49

[58] Field of Search ..... 235/1 R, 1 E, 235/7 R, 10, 22; 211/51; 206/449, 560, 565; 220/507; 109/49

[56] References Cited

U.S. PATENT DOCUMENTS

| | | | |
|---|---|---|---|
| 499,432 | 6/1893 | Lumley | 206/449 |
| 630,314 | 8/1899 | Bankmann et al. | 211/51 |
| 1,383,890 | 7/1921 | Wheeler | 206/565 |
| 2,084,409 | 6/1937 | Peterson | 211/51 |
| 2,594,653 | 4/1952 | Jertson | 206/565 |
| 2,633,615 | 4/1953 | Donovan | 206/449 |
| 2,728,520 | 12/1955 | Moyle | 235/22 |
| 3,610,408 | 10/1971 | Strobl, Jr. | 206/565 |
| 3,892,309 | 7/1975 | Coffey et al. | 206/449 |

OTHER PUBLICATIONS

Cash Box with Leaf Spring Bill Weight (Major Metalfab, Inc. May 26, 1990).

Cash Tray with Bill Weight, Toe Out (Major Metalfab, Inc. Mar. 21, 1984) (large illustration) and Cash Box with Leaf Spring Bill Weight (Major Metalfab, Inc., Feb. 8, 1981) (Small illustration).

*Primary Examiner*—Michael L. Gellner
*Assistant Examiner*—Eddie C. Lee
*Attorney, Agent, or Firm*—Gomer W. Walters

[57] ABSTRACT

A cash box is disclosed. It has a flat base and four sides perpendicular to the flat base. The box also has a wire form plate comprising an elongate sheet of rigid material with tubes having an open inner diameter and mitered ends so that the shortest dimension of the tube is nearest the flat base of the box. The box also includes a bill weight comprising an integral length of resilient wire having a center section, two arms diverging from the center section and a pair of end segments extending from the two arms into the mitered ends of one of the tubes, the two arms being inwardly biased. The bill weight is rotatable in the tube.

11 Claims, 2 Drawing Sheets

CASH BOX WITH BILL WEIGHTS

This application is a continuation of application Ser. No. 08/364,417, filed Dec. 27, 1994, now abandoned, which is a continuation of application Ser. No. 08/111,991, filed Aug. 25, 1993, abandoned.

BACKGROUND OF THE INVENTION

1. Field of the Invention

The present invention relates to cash boxes having compartments for receiving and holding paper currency and negotiable instruments, and more particularly to such cash boxes with bill weights to hold the currency and instruments within their respective compartments.

2. Description of the Prior Art

Cash boxes having compartments for receiving and holding paper currency and negotiable instruments are known in the art. Also, it is known to provide weights which may be set to hold papers tightly against the floor of a respective compartment, and which may be raised to allow currency to be removed from or added to the compartment.

However, such prior cash boxes frequently are time-consuming to manufacture and may include many parts, both factors adding to the costs of the cash box.

SUMMARY OF THE INVENTION

An object of the present invention is to provide a cash box of the type having compartments for receiving and holding paper currency and negotiable instruments, with bill weights for holding the papers in place.

A further object of the present invention is to provide such a cash box wherein the bill weights may be rotated upwardly to allow papers to be removed from or added to the compartment.

A further object of the present invention is to provide such a cash box wherein the bill weights use a spring action for lowering the bill weight into position against the papers.

A further object of the present invention is to provide such a cash box using a resilient member to retain the papers in the compartments so that the papers are retained independent of the orientation of the cash box.

A further object of the present invention is to provide such a cash box utilizing a resilient bill weight with a dual bias to maintain the bill weights in position against the papers.

A further object of the present invention is to reduce the manufacturing costs of such cash boxes.

A further object of the present invention is to provide such a cash box wherein the manufacture of the cash box is simplified.

A further object of the present invention is to provide such a cash box wherein the number of parts employed is reduced to simplify manufacture.

A further object of the present invention is to provide such a cash box wherein a single element provides a base for a plurality of bill weights.

The present invention meets these objects by providing a box having a base. A tube is disposed above and substantially parallel to the base, the tube having an open inner diameter and mitered ends so that the shortest dimension of the tube is nearest the base of the box. The cash box also has a bill weight comprising an integral length of resilient wire having a center section, two arms diverging from the center section and a pair of end segments extending from the two arms into and rotatable within the mitered ends of the tube, the two arms being inwardly biased.

In another aspect, the present invention provides a cash box comprising a box having a flat base and a side perpendicular to the base. Also included is a wire form plate comprising an elongate sheet of rigid material with a straight bottom edge disposed along the flat base, a planar surface disposed against one of the sides of the box, and a plurality of tubes, each tube having an open inner diameter and mitered ends so that the shortest dimension of the tube is nearest the flat base of the box, the centerlines of the tubes being co-linear and offset from the planar surface of the wire form plate. A plurality of bill weights are also included, each bill weight comprising an integral length of resilient wire having a center section, two arms diverging from the center section and a pair of end segments extending from the two arms into and rotatable within the mitered ends of one of the tubes, the two arms being inwardly biased.

DETAILED DESCRIPTION OF THE ILLUSTRATED EMBODIMENT

Figure 1:
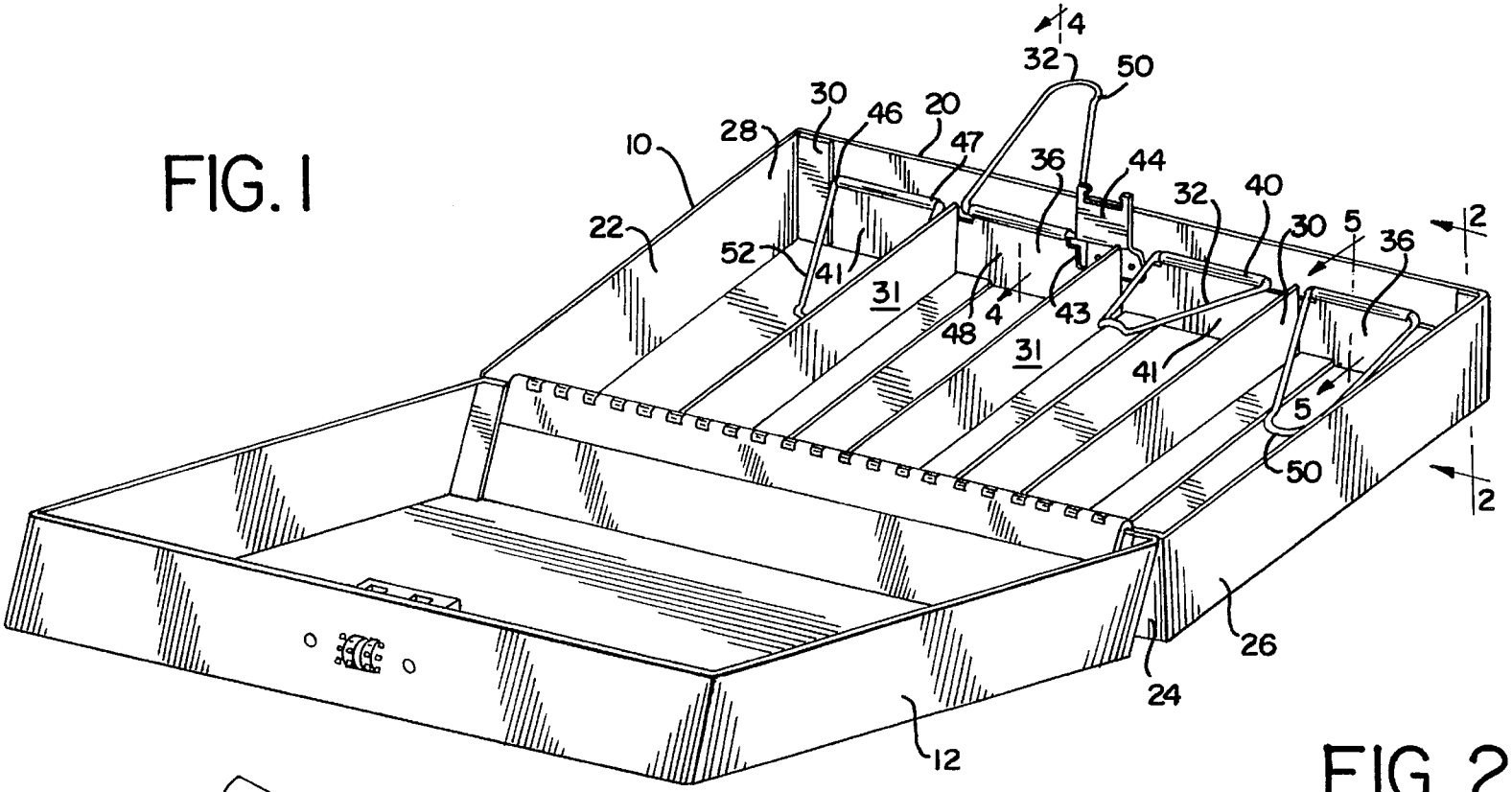
FIG. 1 is a perspective view of an embodiment of the cash box of the present invention.

As shown in FIG. 1, the present invention provides a simplified cash box 10 having hinged top and bottom halves 12, 14. In the illustrated embodiment, the bottom half 14 of the cash box has a flat base 16 and four integral sides 20, 22, 24, 26, each side being perpendicular to and extending upwardly from the planar base 16 to form a rectangular container 28 open at the top. The cash box may be closed by placing the top half 12 over the bottom half 14, and the box may then be locked closed for security.

The rectangular container 28 is divided into a plurality of parallel rectangular compartments 30 for receiving and holding papers, that is, paper currency and negotiable instruments. The compartments 30 are defined by the sides 20, 22, 24, 26 and a plurality of parallel partitions 31 extending between two opposite sides 20, 24 of the bottom half of the box.

The box may be made of a sheet of steel or similar material, with the sides cut and then bent into proper position and welded in place or the like. The partitions may also be formed of steel sheeting bent into proper shape and then welded to the flat base 16 of the box.

A plurality of bill weights 32, mounted on a wire form plate 36, are provided, one bill weight 32 being associated with each compartment 30 for holding the papers within the compartment. As shown in FIG. 1, the bill weights may be raised as desired for removing or adding papers to the compartments, and may be lowered to retain the papers in the compartments.

Figure 3:
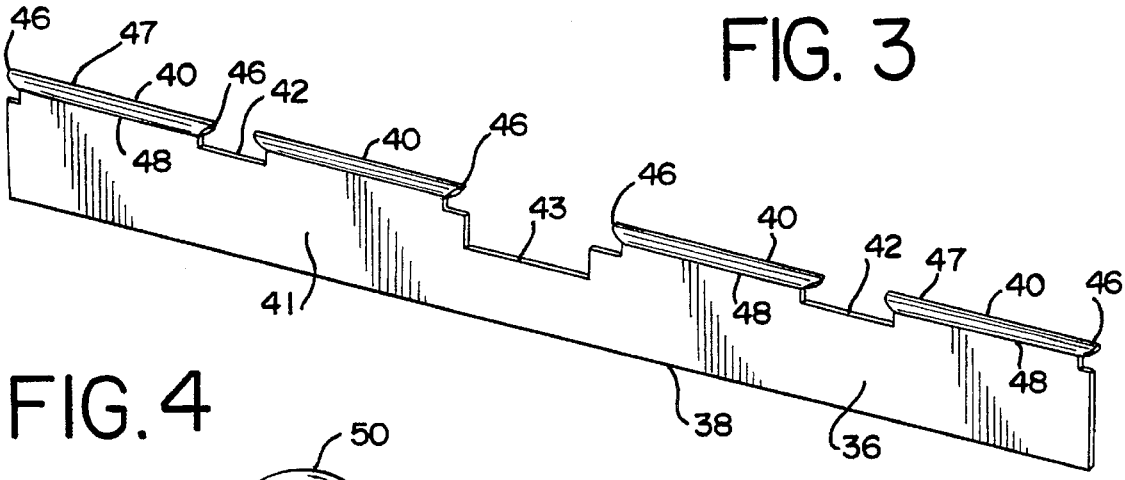
FIG. 3 is a perspective view of the wire form plate of the cash box of the present invention, removed from the cash box and with bill weights removed for clarity of illustration.

As shown in FIG. 3, the wire form plate 36 is an elongate plate, preferably made of steel, having a flat bottom edge 38 and defining a plurality of tubes 40 at its top. The centerlines of the tubes 40 are parallel to the flat base 16, and the tubes 40 are co-linear and spaced from each other by a top edge 42. The top edge 42 may have a recess 43 at the center of the plate 36 so that the plate 36 may fit around one of the lock members 44.

Figure 2:
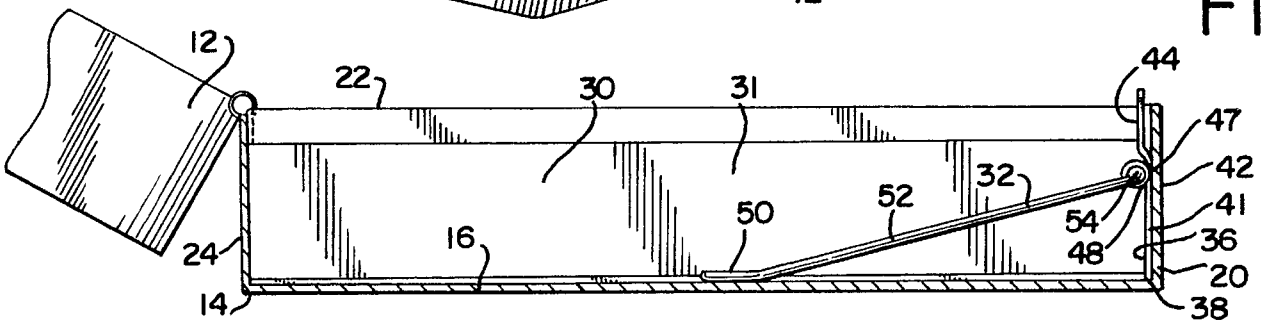
FIG. 2 is a cross-section taken along line 2—2 of FIG. 1.

As shown in FIGS. 1 and 2, the flat bottom edge 38 of the plate 36 is disposed on the flat base 16, and the planar surface 41 of the plate 36 is positioned flush against the side 20 of the bottom half 14 of the cash box 10. The centerlines of the tubes 40 are slightly offset from the planar surface 41 to allow the planar surface to be set flat against the side 20 of the box. Each tube 40 is centered at the head of each compartment 30, spaced slightly from the partitions 31 and side walls 22, 26 which define the compartments. The plate 36 may be welded or similarly attached flush to the side 20 of the box.

Figure 4:
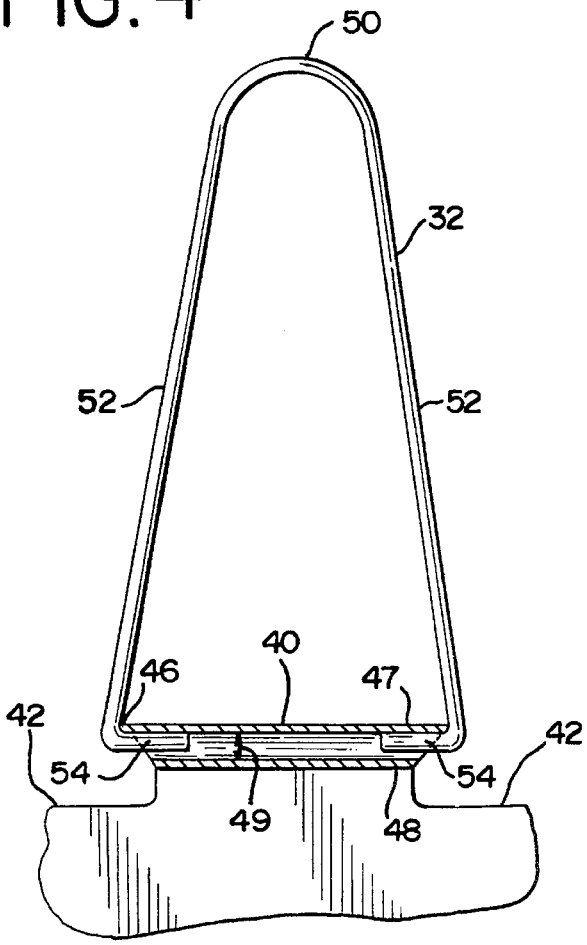
FIG. 4 is an enlarged partial cross-section, taken along line 4—4 of FIG. 1, showing one bill weight in a raised position on a portion of the cash box.
Figure 5:
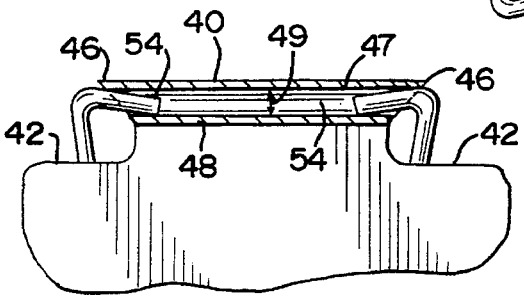
FIG. 5 is an enlarged partial cross-section, taken along line 5—5 of FIG. 1, showing one bill weight in a lowered position on a portion of the cash box.

As shown in FIGS. 3–5, each tube 40 has mitered or beveled ends 46. In the illustrated embodiment, the ends 46 are mitered at an angle of about forty-five degrees. The ends are mitered so that they converge toward the flat base 16, with the shortest dimension of each tube being nearest the flat base 16. Thus, each tube 40 is widest at its highest level 47 and most narrow at its lowest level 48, that is, at the level of the tube most near to the flat base 16.

As illustrated, each bill weight 32 comprises an elongate wire bent to provide a curved center 50 with two integral arms 52 and two integral end segments 54. When in place on the wire form plate 36, the end segments 54 are in place within the ends of the tubes 40, to hold the bill weight on the plate.

As shown in FIGS. 4 and 5, the inner diameter 49 of each tube 40 is substantially greater than the outer diameter of each bill weight 32; in the illustrated embodiment, the inner diameter is more than twice the outer diameter of the bill weight. Thus, the position of the centerline of the bill weight wire may vary with respect to the centerline of the tube: when the bill weight is fully raised as in FIG. 4, the centerline of the end segments 54 of the bill weight wire are parallel to and above the centerline of the tube; when the bill weight is lowered as in FIG. 5, the centerlines of the end segments 54 of the bill weight wire may be at or below the centerline of the tube, and may not be parallel to the centerline of the tube.

As best seen in FIGS. 1 and 2, the curved center section 50 of each bill weight 32 lies in a different plane than a substantial length of the arms 52 and end segments 54. Thus, as shown in FIG. 2, the center curved section 50 of each bill weight will lie substantially flat against the flat base 16 when the bill weight is in its down position, as shown in FIGS. 1 and 2, while the end segments 54 remain spaced above the flat base 16.

Figure 6:
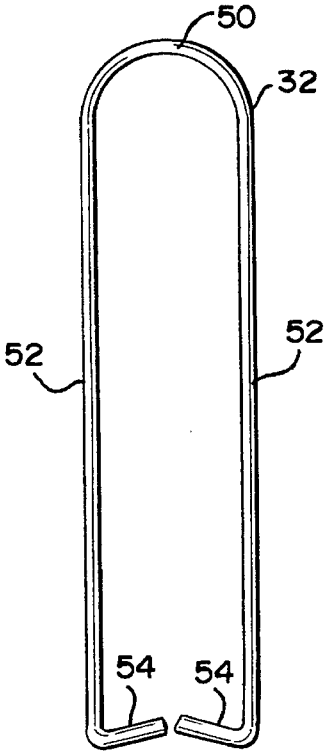
FIG. 6 is a plan view of a bill weight prior to installation on a cash box.

As shown in FIG. 6, each bill weight 32 is formed of a single resilient wire, bent to define the curved center section 50, with the arms 52 being substantially parallel to each other prior to mounting on the wire form plate 36, the parallel arms 52 being spaced about 0.92 inches apart in the illustrated embodiment. Also prior to mounting on the wire form plate 36, the end segments 54 of each bill weight are not co-linear, but are angled to converge toward the curved center section 50.

Each bill weight 32 is made of a resilient material. Thus, when mounted on the wire form plate as shown in FIG. 4, the two arms 52 are forced out of parallel to straddle the dimension of the tube 40, and the end segments 54 are forced into a less angular relationship to fit within the ends 46 of the tube. Thus, once mounted on the wire form plate 36, the bill weight 32 is biased in two ways: the arms 52 are biased toward each other and the end segments 54 are biased toward their adjacent arms 52.

The dual bias of the bill weight 32 cooperates with the mitered ends 46 and dimensions of the tube 40 so that the bill weight snaps down into position against the papers in the compartment 30 when the bill weight is pushed downward out of the vertical position. Moreover, the dual bias serves to bias the bill weight in the position shown in FIG. 2.

As shown in FIG. 4, when the bill weight 32 is raised to the vertical position for the removal or addition of papers, because the ends 46 of the tube 40 are mitered, the arms 52 are forced to diverge further, and the end segments 54 of the bill weights 32 are forced into a co-linear relationship. And, as shown in FIG. 4, the end segments 54 of the bill weight 32 are held against the inner surface of the top of the tube 40. But when the bill weight is moved out of the vertical position, the inward bias of the arms 52 causes the arms to move down the mitered ends 46 of the tube to the narrowest part of the tube near the top edge 42 of the wire form plate 36. And since the inner diameter 49 of the tube is wider than the diameter of the bill weight wire, the bias of the arms of the bill weight forces the bill weight to move to the position shown in FIG. 5, wherein the junctures of the end segments and arms of the bill weight are at the most narrow part of the tube, substantially at the lowest level 48 of the tube. In this position, the shape of the bill weight maintains the curved center section 50 flat against the papers in the compartment.

Although the invention has been disclosed and described in its preferred form with a certain degree of particularity, it is understood that the present disclosure of the preferred form is only by way of example and that numerous changes in the details of operation and in the combination and arrangement of parts may be made without departing from the spirit and scope of the invention as hereinafter claimed.

I claim:

1. A cash box comprising:

a box having a base and side walls extending upwardly from the base;

a tube disposed above and substantially parallel to the base, the tube being supported along one of the side walls of the box and having an open inner diameter and mitered ends so that the tube has a longest and a shortest axial dimension, the shortest axial dimension of the tube being nearest the base of the box; and a bill weight comprising an integral length of resilient wire having a center section, two arms diverging from the center section and a pair of end segments, each of the end segments secured at a first end thereof to a corresponding one of the arms and having a second end thereof extending from the corresponding arm to be inserted into the tube, each of the end segments being rotatable within the mitered ends of the tube, the two arms being inwardly biased toward one another when the end segments are placed within the mitered ends of the tube, and each of the two end segments being formed at an angle with respect to its corresponding arm to bias the second ends of the end segments toward the center section of the bill weight to provide a further retaining force when the arms converge along the mitered ends of the tubes.

2. A cash box as claimed in claim 1 wherein the tube has an axial centerline, the bill weight has a uniform outer diameter and the end segments of the bill weight have axial centerlines, with the outer diameter of the bill weight being less than the inner diameter of the tube so that the positions of the axial centerlines of the end segments of the bill weight wire may vary with respect to the axial centerline of the tube.

3. A cash box as claimed in claim 1 wherein the box has a plurality of compartments for receiving and holding currency and wherein the cash box has a plurality of tubes, one tube associated with each compartment, and wherein a bill weight is associated with each tube.

4. A cash box as claimed in claim 1 wherein:

the box has a wire form plate to support the tube along one of the side walls of the box, the wire form plate comprising a sheet of rigid material with a straight bottom edge disposed against the base and a planar surface disposed against one side of the box; and the tube is integral with the wire form plate.

5. A cash box comprising:

a box having an interior space in which is located a base and side walls extending upwardly from the base;

a wire form plate comprising a sheet of rigid material with a straight bottom edge disposed against the base of the box and a planar surface disposed against one side of the box;

a plurality of tubes integrally formed with the wire form plate, each tube having an axial centerline, the axial centerlines of the tubes being co-linear and offset from the planar surface of the wire form plate in the interior of the box, each of the tubes being disposed above and substantially parallel to the base and having an open inner diameter and mitered ends so that each tube has a longest and a shortest axial dimension, the shortest axial dimension of each tube being nearest the base of the box; and a bill weight associated with each tube, each bill weight comprising an integral length of resilient wire having a center section, two arms diverging from the center section and a pair of end segments extending from the two arms into and rotatable within the mitered ends of the tube, the two arms being inwardly biased toward one another when the end segments are located in the tube and the two end segments being biased toward the center section of the bill weight when the arms converge along the mitered ends of the tubes.

6. A cash box comprising:

a box having an interior, the box also having a flat base and sides perpendicular to the base;

a wire form plate comprising an elongate sheet of rigid material with a straight bottom edge disposed along the flat base and a planar surface disposed against one of the sides of the box;

a plurality of tubes, each tube having an open inner diameter, an axial centerline, a shortest axial dimension and a longest axial dimension and mitered ends, each tube being positioned so that the shortest axial dimension of the tube is nearest the flat base of the box, the axial centerlines of the tubes being co-linear and offset from the plane of the planar surface of the wire form plate toward the interior of the box; and a plurality of bill weights, each bill weight comprising an integral length of resilient wire having a center section, two arms diverging from the center section and a pair of end segments extending from the two arms into and rotatable within the mitered ends of one of the tubes, the two arms being inwardly biased.

7. A cash box as claimed in claim 6 wherein each bill weight has a uniform outer diameter and the end segments of the bill weight wire have axial centerlines, the outer diameter of the bill weight being less than the inner diameter of the associated tube so that the position of the axial centerlines of the end segments of the bill weight wire may vary with respect to the axial centerline of the tube.

8. A cash box as claimed in claim 7 wherein the box has a plurality of compartments for receiving and holding currency and wherein one tube of the wire form plate is associated with each compartment.

9. A cash box as claimed in claim 8 wherein the end segments are biased toward the center section of the bill weight.

10. A cash box as claimed in claim 6 wherein the end segments are biased toward the center section of each bill weight.

11. A cash box comprising:

a box having an interior with a plurality of compartments for receiving and holding currency, the box also having a flat base and side walls perpendicular to the base;

a wire form plate comprising an elongate sheet of rigid material with a straight bottom edge disposed along the flat base and a planar surface disposed against one of the side walls of the box, and a plurality of tubes, each tube being located in a separate one of the compartments and having an open inner diameter, an axial centerline, a shortest axial dimension, a longest axial dimension and mitered ends, each tube being positioned so that the shortest dimension of the tube is nearest the flat base of the box, the axial centerlines of the tubes being co-linear and offset from the plane of the planar surface of the wire form plate toward the interior of the box; and a plurality of bill weights, each bill weight comprising an integral length of resilient wire having a center section, two arms diverging from the center section and a pair of end segments, each of the end segments secured at a first end thereof to a corresponding one of the arms and having a second end thereof extending from the corresponding arm to be inserted into the tube, each of the end segments being rotatable within the mitered ends of the associated tube, each bill weight having a uniform outer diameter and the end segments of the bill weight wire having axial centerlines, the outer diameter of the bill weight being less than the inner diameter of the associated tube, so that the positions of the axial centerlines of the end segment of the bill weight wire may vary with respect to the axial centerline of the associated tube, the two arms of each bill weight wire being inwardly biased toward one another when the end segments are placed within the mitered ends of the associated tube and each of the end segments of each bill weight wire being formed at an angle with respect to its corresponding arm to bias the second ends of the end segments toward the center section of that bill weight to provide a further retaining force when the arms converge along the mitered ends of the corresponding tube.

* * * * *